US011225722B2

(12) United States Patent
Ye

(10) Patent No.: US 11,225,722 B2
(45) Date of Patent: Jan. 18, 2022

(54) ALKALINE CUPRIC CHLORIDE ETCHANT FOR PRINTED CIRCUIT BOARD

(71) Applicant: Tao Ye, Guangdong (CN)

(72) Inventor: Tao Ye, Guangdong (CN)

( * ) Notice: Subject to any disclaimer, the term of this patent is extended or adjusted under 35 U.S.C. 154(b) by 520 days.

(21) Appl. No.: 16/322,459

(22) PCT Filed: Aug. 4, 2017

(86) PCT No.: PCT/CN2017/095947
§ 371 (c)(1),
(2) Date: Jan. 31, 2019

(87) PCT Pub. No.: WO2018/028514
PCT Pub. Date: Feb. 15, 2018

(65) Prior Publication Data
US 2021/0332484 A1 Oct. 28, 2021

(51) Int. Cl.
*C23F 1/34* (2006.01)

(52) U.S. Cl.
CPC ..... *C23F 1/34* (2013.01)

(58) Field of Classification Search
None
See application file for complete search history.

(56) References Cited

U.S. PATENT DOCUMENTS

2006/0040595 A1* 2/2006 Svirchevski ..... B24B 37/042 451/56
2006/0243700 A1* 11/2006 Rippstein ..... H05K 3/1225 216/12
2015/0361341 A1* 12/2015 Ye ..... C23F 1/18 216/13
2015/0361342 A1* 12/2015 Ye ..... C09K 13/04 252/79.2
2017/0058408 A1* 3/2017 Ye ..... C25B 1/22

FOREIGN PATENT DOCUMENTS

| | | |
|---|---|---|
| CN | 1130408 | 9/1996 |
| CN | 104862703 | 8/2015 |
| JP | 2005105410 | 4/2005 |

OTHER PUBLICATIONS

Xueming Li, "Printed Circuit Technology", Occupational Skill Testing Authority of Electronic Industry of Ministry of Industry and Information Technology, Apr. 2012, pp. 387-389.
Baoming Wei, "Theory and Application of Metal Corrosion", Chemical Industry Press, Dec. 1984, pp. 5-7.
Tian et al., "Discussion in Methods of Etch Factor Calculation", Printed Circuit Information, Dec. 2007, p. 55-56.
"International Search Report (Form PCT/ISA/210)", dated Nov. 7, 2017, with English translation thereof, pp. 1-4.

* cited by examiner

*Primary Examiner* — Allan W. Olsen
(74) *Attorney, Agent, or Firm* — JCIPRNET

(57) ABSTRACT

An alkaline cupric chloride etchant for a printed circuit board, comprising copper chloride and a sub-etchant. The sub-etchant comprises the following in percentage by weight: 10 to 30 percent of ammonium chloride, 0.0002 to 25 percent of carboxylic acid and/or ammonium carboxylate, 0.01 to 45 percent of ammonium carbonate and/or ammonium bicarbonate, 0.0001 to 20 percent of one or more selected from hydroxylamine hydrochloride, hydroxylamine sulphate and hydrazine hydrate, the balance being water. The initial feed amount B of copper chloride is calculated according to the following formula: B=(134.5/63.5)x the set value of the copper ion concentration A; the control parameter of the production process of the resulting etchant is set to be: the copper ion concentration of 30-170 g/L.

8 Claims, No Drawings

ALKALINE CUPRIC CHLORIDE ETCHANT FOR PRINTED CIRCUIT BOARD

CROSS-REFERENCE TO RELATED APPLICATION

This is a 371 application of the International PCT application serial no. PCT/CN2017/095947, filed on Aug. 4, 2017, which claims the priority benefits of China Application No. 201610647941.3, filed on Aug. 9, 2016. The entirety of each of the above-mentioned patent applications is hereby incorporated by reference herein and made a part of this specification.

BACKGROUND

Technical Field

The invention relates to an etchant for printed circuit board. More specifically, the invention relates to a high-efficiency and environmental-friendly alkaline cupric chloride etchant for printed circuit board.

Description of Related Art

The etching process of a printed circuit board (PCB) is as follows: applying an etchant on a pre-developed copper-clad laminate and etching away the unprotected, non-conductor part of the PCB, in order to form a circuit. The etching of the non-conductor part utilizes redox reactions between the etchant and the copper. Said pre-developed copper-clad laminate is made in previous processes and has a pattern.

At present, acidic cupric chloride etchant and alkaline cupric chloride etchant are two widely applied etching systems in industry. Wherein, the copper etching agent of the alkaline cupric chloride etchant is copper(II) ammonia complex $Cu(NH_3)_4Cl_2$ formed from the complexation reaction between cupric chloride and ammonium hydroxide, and the etching agent is regenerated via a reaction involving oxygen, $NH_4^+$ and $Cr^-$.

The main components of traditional alkaline cupric chloride etchants are copper(II) ammonia complex $Cu(NH_3)_4Cl_2$, ammonium chloride and ammonium hydroxide, wherein $Cu(NH_3)_4Cl_2$ can be obtained from the complexation reaction between ammonium hydroxide and cupric chloride:

$$CuCl_2+4NH_4OH \rightarrow Cu(NH_3)_4Cl_2+4H_2O$$

And then, the copper on the printed circuit board is oxidized by $[Cu(NH_3)_4]^{2+}$:

$$Cu(NH_3)_4Cl_2+Cu \rightarrow 2CU(NH_3)_2Cl.$$

The copper(I) ammonia complex ions $[Cu(NH_3)_2]^+$ formed lack etching ability. When excessive $NH_4^+$ and $Cl^-$ are present in the etchant, $[Cu(NH_3)_2]^+$ are rapidly oxidized to copper(II) ammonia complex ion $[Cu(NH_3)_4]^{2+}$ by oxygen in the air, which can again participate in the copper etching process. Alternatively speaking, copper(II) ammonia complex ions [Cu(NH3)4]2+ are regenerated:

$$4Cu(NH_3)_2Cl+4NH_4Cl+4NH_4OH+O_2 \rightarrow 4Cu(NH_3)_4Cl_2+6H_2O$$

As the components in the etchant change continuously during the etching process, an automatic detection and feeding control machine is generally employed in industrial production to detect a specific gravity parameter of the etchant for replenisher addition, in order to achieve automatic continuous regeneration of the alkaline cupric chloride etchant and thus maintain a stable etching rate. Generally, the etchant is consisted of the following components:

1. cupric chloride;
2. sub-etchant: generally a mixture of ammonium hydroxide and aqueous ammonium chloride solution.

During the etching process, the etchant continuously reacts with copper, and the content of each component in the etchant changes accordingly. In order to achieve a stable etching rate as well as fulfil etching quality requirements, the specific gravity of the etchant is adjusted via sub-etchant supplement controlled by an automatic detection and feeding control machine, so that concentrations of certain components in the etchant remain within set ranges.

Traditional alkaline cupric chloride etchant has a corrosive effect on liquid and dry-film photoresists, preventing fabrication of fine-line PCB with high quality, causing a series of environmental problems during etching process. In order to solve mentioned problems, a high-efficiency, high-quality and safe alkaline cupric chloride etchant for printed circuit board was mentioned by the inventor in the Chinese patent application 201510176486.9, which includes cupric chloride and sub-etchant, and the sub-etchant includes the following components in percentage by weight:

10%-30% $NH_4Cl$;

0.0002%-25% carboxylic acid and/or ammonium carboxylate;

0.3%-25% ammonium hydroxide;

and the balance of water;

Due to addition of carboxylic acid and/or ammonium carboxylate to sub-etchant, the mentioned alkaline cupric chloride etchant can be operated under condition of pH<8.0 while the required production rate of large-scale production is satisfied. The content of ammonium hydroxide is low, providing excellent safety and environmental protection.

However, the mentioned etchant system has the following imperfections which are remained to be improved:

(1) Under condition of pH<8.0, over-evaporation of ammonium hydroxide easily occurs and hence affect etching rate. Monitoring of pH and specific gravity during etching process is therefore required. In addition, adding ammonium hydroxide separately to etchant, in order to precisely controlling pH and copper ion concentration in etchant, maintaining steady etching rate and etching quality;

(2) Although the etchant is obviously improved in safety and environmental protection comparing to traditional alkaline etchant, ammonium hydroxide is also applied as the main source of ammonium ion, so that the problem of ammonia gas evaporation remains to be addressed.

SUMMARY

As used herein, the singular forms "a", "an" and "the" are intended to include the plural forms as well, unless the context clearly indicates otherwise. The present invention aims at providing a high-efficiency and environmental-friendly alkaline cupric chloride etchant for printed circuit board. The said alkaline cupric chloride etchant can avoid most ammonia evaporation during etching process, and pH monitoring system for etchant pH control is not needed.

The purpose of the invention is realized by the following technical proposal:

A high-efficiency and environmental-friendly alkaline cupric chloride etchant for printed circuit board, comprising cupric chloride and a sub-etchant, wherein an automatic detection and feeding control machine is used for controlling the specific gravity of the etchant, in order to keep the concentration of copper ions in the etchant no less than a set value; the high-efficiency and environmental-friendly alkaline cupric chloride etchant for printed circuit board is characterized in that:

the sub-etchant includes the following components in percentage by weight:

10%-30% $NH_4Cl$;

0.0002%-25% carboxylic acid and/or ammonium carboxylate;

0.01%-45% ammonium carbonate and/or ammonium bicarbonate;

0.0001%-20% of one or more compounds selected from hydroxylamine hydrochloride, hydroxylamine sulphate, and hydrazine hydrate;

and the balance of water;

the initial feed amount B of the cupric chloride is obtained by calculation according to the following formula:

$$B=(134.5/63.5)\times\text{set value } A \text{ of the concentration of copper ions;}$$

control parameters of a production process of the etchant are set as follows: the concentration of copper ions is 30-170 g/L.

When both carboxylic acid and ammonium carboxylate are selected at the same time, they can be mixed in any proportion. When two or more compounds are selected from hydroxylamine hydrochloride, hydroxylamine sulphate, and hydrazine hydrate at the same time, there are no limitations on mixing ratio of the compounds; they can be mixed in any proportion.

The invention was developed from the basis of Chinese invention application 201510176486.9. The followings are the three main points of improvement:

(1) Ammonium hydroxide in sub-etchant is replaced by ammonium carbonate and/or ammonium bicarbonate, and its applying amount is accordingly adjusted;

(2) One or more compounds selected from hydroxylamine hydrochloride, hydroxylamine sulphate, and hydrazine hydrate is added to sub-etchant;

(3) pH monitoring system for etchant pH control and separate addition of ammonium hydroxide are not needed in situation of normal etching production.

About Application of Ammonium Carbonate and/or Ammonium Bicarbonate

The invention applies ammonium carbonate and/or ammonium bicarbonate as one of the ammonium ion sources in the etchant, replacing ammonium hydroxide in the sub-etchant in prior art. According to studies by the inventor, the characteristic of ammonium carbonate and ammonium bicarbonate is: they can decompose steadily in constant speed under etching operating temperature of 45-50° C. to ammonia gas, water and carbon dioxide, without production of any other impurity. The generated ammonia gas can rapidly dissolved into solution, forming isolated ammonium ions.

Reaction equation of decomposition of ammonium carbonate:

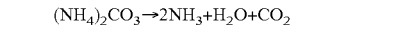

$$(NH_4)_2CO_3 \rightarrow 2NH_3+H_2O+CO_2$$

Reaction equation of decomposition of ammonium bicarbonate:

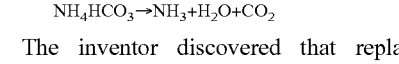

$$NH_4HCO_3 \rightarrow NH_3+H_2O+CO_2$$

The inventor discovered that replacing ammonium hydroxide with ammonium carbonate and/or ammonium bicarbonate has the following advantages:

(1) There is No Need to Setting Up pH Monitoring System for Etchant pH Control and Separate Addition of Ammonium Hydroxide The inventor found out that the etchant of the invention can avoid unsteady etching speed under condition of pH<8.0. This is because: concentration of ammonium ion in ammonium carbonate and/or ammonium bicarbonate solution is higher than that in ammonium hydroxide solution with the same pH value. That is, under identical pH value, the content of ammonium ion in the etchant system is higher than that in existing alkaline cupric chloride etchant systems, and unstable etching rate due to too-low concentration of ammonium ion will not occur. Therefore, pH monitoring system is not needed for the etchant of the invention during normal etching production, and only control of sub-etchant feeding by specific gravity detecting system is required. The controlling system is simplified, and cost is decreased.

(2) High Etching Rate

As mentioned above, under the same pH value, the content of ammonium ion in the etchant system is higher than that in existing alkaline cupric chloride etchant systems, so that the etching rate is relatively increased.

(3) Obviously Decreased Ammonia Gas Evaporation Achieving Safe and Environmental-Friendly Process Ammonium carbonate and/or ammonium bicarbonate can decompose in a steady speed and release ammonia gas, which is able to dissolve in the etchant immediately. Furthermore, the etchant also contains carboxylic acid and/or ammonium carboxylate, so that most ammonia gas dissolved in water turns into ammonium carboxylate, and the possibility of ammonia gas evaporation is further decreased. According to experimental studies by the inventor, when the content of ammonium carbonate and/or ammonium bicarbonate in the etchant is within the range of 0.0002%-25%, most ammonia gas produced by decomposition of ammonium carbonate and ammonium bicarbonate is able to completely dissolve in water. Ammonia gas is uneasy to escape, and hence no obvious ammonia odor during etching process.

(4) Improved Etching Quality

As ammonium carbonate and/or ammonium bicarbonate require heat to decompose and produce ammonia gas, with the same amount of ammonia ion in etchant, the etchant of the invention can always maintain the concentration of ammonium hydroxide at a relatively low level, and correspondingly the concentration of isolated $OH^-$ ion in etchant caused by ionization of ammonium hydroxide is relatively low. In addition, the carboxyl group of carboxylic acid and/or ammonium carboxylate in etchant is able to form hydrogen bondings with part of isolated $OH^-$ ions, further decreasing the concentration of isolated $OH^-$ ion in etchant, and relatively alleviating the corrosive effect of etchant on dry-film or liquid photoresists covered on printed circuit boards. Etching quality is hence improved.

About Application of One or More Compounds Selected from Hydroxylamine Hydrochloride, Hydroxylamine Sulphate, and Hydrazine Hydrate The inventor found out that, the one or more compounds selected from hydroxylamine hydrochloride, hydroxylamine sulphate, and hydrazine hydrate has a synergistic effect with ammonium carbonate and/or ammonium bicarbonate, and that further improves etching ability of etchant.

During etching process, oxygen gas dissolved in etchant reacts with copper surface, forming a layer of alkaline metallic oxide. Since copper(II) ammonia complex reacts slowly with the metallic oxide layer, and ammonium carbonate and/or ammonium bicarbonate takes part in the regeneration reaction of copper(II) ammonia complex only after thermal decomposition and ammonia gas generation, with the same content of ammonium ion, the etchant applying ammonium carbonate and/or ammonium bicarbonate to replace ammonium hydroxide has a relatively low concentration of ammonium hydroxide. The etching ability of etchant is thus insufficient, and unsuitable for industrialized production. The inventor discovered that, after addition of one or more compounds selected from hydroxylamine hydrochloride, hydroxylamine sulphate, and hydrazine hydrate, etching rate can be effectively improved, so that the above-mentioned problem is addressed. Due to the reductive ability of hydroxylamine hydrochloride, hydroxylamine sulphate and hydrazine hydrate, formation of alkaline metallic oxide layer hindering etching reaction can be avoided, allowing smooth copper etching reaction of copper(II) ammonia complex in etchant. Etching rate of the etchant selecting ammonium carbonate and/or ammonium bicarbonate as the source of ammonium ion is therefore increased, making it suitable for industrialized production.

Under the synergistic effect between ammonium carbonate and/or ammonium bicarbonate and one or more compounds selected from hydroxylamine hydrochloride, hydroxylamine sulphate and hydrazine hydrate, the etchant of the invention has greatly improved etching rate and etching quality comparing to present technologies.

Preferably, the sub-etchant comprises the following components in percentage by weight:

15%-30% $NH_4Cl$;

0.5%-13% carboxylic acid and/or ammonium carboxylate;

2%-30% ammonium carbonate and/or ammonium bicarbonate;

0.01%-15% of one or more compounds selected from hydroxylamine hydrochloride, hydroxylamine sulphate, and hydrazine hydrate;

and the balance of water.

More preferably, the sub-etchant comprises the following components in percentage by weight:

15%-25% $NH_4Cl$;

1%-10% carboxylic acid and/or ammonium carboxylate;

5%-25% ammonium carbonate and/or ammonium bicarbonate;

0.1%-10% of one or more compounds selected from hydroxylamine hydrochloride, hydroxylamine sulphate, and hydrazine hydrate;

and the balance of water.

Preferably, the carboxylic acid is one or more compounds selected from the group consisting of formic acid, citric acid and malic acid; the ammonium carboxylate is one or more compounds selected from the group consisting of ammonium formate, ammonium citrate and ammonium malate.

Formic acid, citric acid, malic acid, ammonium formate, ammonium citrate and ammonium malate can all release carboxylate anions ($RCOO^-$) in the etchant, which is the actual active species. Therefore, there are no limitations on the mixing ratio of these compounds, as long as the percentage by weight of carboxylic acid and/or ammonium carboxylate added into the sub-etchant is within the range of the invention.

Preferably, the alkaline cupric chloride etchant for printed circuit board further includes ammonium hydroxide.

The invention can also increase concentration of isolated ammonium ion in etchant via addition of ammonium hydroxide during etching process, in order to promote etching rate more effectively. Ammonium hydroxide can be added either separately to sub-etchant or etching tank, or simultaneously to both sub-etchant and etching tank.

More preferably, based on percentage by weight of the alkaline cupric chloride etchant for printed circuit board, further includes ≤25% by weight of ammonium hydroxide.

More preferably, an automatic detection and feeding control machine is used for monitoring of pH value of etchant, controlling feeding of ammonium hydroxide.

Preferably, the control parameters of the production process of the obtained etchant are set as follows: the concentration of copper ions is 30-170 g/L, the pH value is 7.0-8.8.

More preferably, the control parameters of the production process of the obtained etchant are set as follows: the concentration of copper ions is 40-160 g/L, the pH value is 7.0-8.4.

In preferred embodiments of the invention, concentration of copper ions and pH value of the etchant are both controlled during etching process, in order to achieve more precisely control of etching rate and etching quality.

Beneficial Effects (1) Simplified Technological Process

The invention can achieve steady etching rate without pH monitoring for etchant pH control and separate addition of ammonium hydroxide to etchant. The most widely used etching equipment in industrial, in which only monitor of copper ion concentration is equipped, can be directly applied, and modification of current equipment is not needed.

(2) High Etching Rate

Under the synergistic effect between ammonium carbonate and/or ammonium bicarbonate and one or more compounds selected from hydroxylamine hydrochloride, hydroxylamine sulphate and hydrazine hydrate, the etchant of the invention not only has a higher concentration of ammonium ion comparing to existing alkaline cupric chloride etching system with identical pH value, but also prevent formation of alkaline metallic oxide layer, providing favorable etching conditions for ammonium ions in etchant to smoothly demonstrate their copper etching ability. It was proved by experimental data that, even with pH<8.0, the etchant of the invention can have an etching rate as high as that of traditional alkaline etchant with pH>8.0, so that requirements of large-scale production are better met.

(3) Lowered Production Cost

As mentioned above, the etchant of the invention has a high copper etching ability that it can have an etching rate as high as that of traditional alkaline etchant with pH>8.0 even when its pH value is below 8.0. Efficiency of etching production is obviously improved under the same pH value, manpower and energy consumption required for production of a single product is greatly decreased, and production cost is accordingly cut down.

(4) Improved Safety and Environmental Protection

The sub-etchant of the invention not only applies ammonium hydroxide as the source of ammonium ion, but obtain ammonium hydroxide mainly via decomposition of ammonium carbonate and/or ammonium bicarbonate. At the same time, ammonium ions in etchant exist in the form of ammonium carboxylate. Concentration of ammonium hydroxide in etchant is low causing less ammonia gas volatilization, thereby preventing ammonia gas from affecting physical health of the production staff and damaging the environment.

DESCRIPTION OF THE EMBODIMENTS

The invention is further described by the following exemplary embodiments. It should be understood that the description and specific examples are intended for purposes of illustration only and are not intended to limit the scope of the present disclosure. Nonessential modification and adjustments made by other people according to the invention still belong to the protection scope of the invention.

In the following exemplary embodiments and comparative examples, the ammonium chloride used is preferably ammonium chloride produced by Guangzhou Chemical Reagent Factory; the formic acid used is preferably formic acid produced by Guangzhou Chemical Reagent Factory; the ammonium formate used is preferably ammonium formate produced by Guangzhou Chemical Reagent Factory; the ammonium hydroxide used is preferably ammonium hydroxide produced by Guangzhou Chemical Reagent Factory; the cupric chloride used is preferably $CuCl_2.2H_2O$ (≥99.0%) produced by Guangzhou Chemical Reagent Factory; the citric acid used is preferably citric acid produced by Guangzhou Chemical Reagent Factory; the malic acid used is preferably DL-malic acid produced by Guangzhou Chemical Reagent Factory; the ammonium citrate used is preferably ammonium citrate produced by Guangzhou Chemical Reagent Factory; the ammonium malate used is preferably ammonium malate produced by Xi'an Dafengshou Biotech Co., Ltd.; the ammonium carbonate used is preferably ammonium carbonate produced by Shanghai Hengyuan Biotech Co., Ltd.; the ammonium bicarbonate used is preferably ammonium bicarbonate produced by Shanghai Lanke Medical Science and Technology Development Co., Ltd.; the hydroxylamine hydrochloride used is preferably hydroxylamine hydrochloride produced by Jiangsu Aikewei Science and Technology Co., Ltd.; the hydroxylamine sulphate used is preferably hydroxylamine sulphate produced by Jiangsu Aikewei Science and Technology Co., Ltd.; the hydrazine hydrate used is preferably hydrazine hydrate produced by Shandong Kaisitong Chemical Co., Ltd. The automatic detection and feeding control machines used are preferably Yegao PCB alkaline etching automatic feeding control machine type-2 which is produced by Guangzhou Yegao Chemical Co., Ltd. In addition to the above-listed products, those of skill in the art can also select products and equipments with similar properties to those listed herein according to conventional choices to achieve the object of the current invention.

Embodiment 1

Step 1: at ambient temperature and pressure, according to the designated components as illustrated in Table 1 below, selected raw materials are dissolved in water to prepare the sub-etchant.

Step 2: cupric chloride was added into per liter of the sub-etchant obtained in step 1; the added amount of cupric chloride was obtained by calculation according to the set value of the concentration of copper ions in the solution listed in Table 1:

$$\frac{\text{molar mass of } CuCl_2}{\text{molar mass of copper ion}} = \frac{\text{mass of } CuCl_2 \text{ to be added per liter of sub-etchant}}{\text{mass of copper ion to be added per liter of sub-etchant}} \quad \text{(Formula 1)}$$

Wherein the molar mass of cupric chloride is 134.5 g/mol; and the molar mass of copper ion is 63.5 g/mol. According to the value specified in embodiment 1 of Table 1, the mass of cupric chloride to be added into per liter of sub-etchant is 190.6 g.

Step 3: the solution obtained in step 2 was poured into an etchant tank, and sensor probes of the automatic detection and feeding control machine were immersed into the etchant.

Step 4: the sub-etchant obtained in step 1 was poured into a sub-etchant supplement tank, which was connected to a charging pump controlled by a specific gravity numerical control meter of the automatic detection and feeding control machine; the temperature of the etchant tank was set to 50° C., the pressure of spray nozzles of the etching machine was set to 2 kg/cm$^2$.

Step 5: the etching operation was started. Sub-etchant was automatically charged and all the components in the etchant were balanced by the automatic detection and feeding control machine, keeping the specific gravity at the numerical values specified; the concentration of copper ions and pH value of the etchant detected by the automatic detection and feeding control machine during etching process were recorded in Table 1.

Test on Etch Quality

The test was carried out using PCBs with size of 620×540 mm, copper foil thickness of 1 oz, line width and line spacing of 50.8 μm and pure copper etching rate test boards with size of 500×300×1.5 mm via spray corrosion testing in an etching machine. The etching rate and etch factor K were calculated using methods known in the art, e.g., those described in *Printed Circuit Technique* by Li Xueming, Occupational Skill Testing Authority of Electronic Industry of Ministry of Industry and Information Technology, fifth edition, p 387-389; *"Theory and Application of Metal Corrosion"*, Wei Baoming, Chemical Industry Press, p 5-7; *Discussion in Methods of Etch Factor Calculation*, Tian Ling, et al., printed circuit information, 2007 No. 12, p 55-56. The calculated results of etching rate and etch factor K are presented in Table 2.

Testing the Impact on Photoresists:

When the various process parameters arrived at set numerical values, printed circuit test boards with the size of 500×300×1.5 mm, and are coated with either liquid or dry film photoresists, were employed for spray corrosion testing in the etching machine for 1 min. The automatic detection and feeding control machine automatically recharged and balanced each component in the etchant, keeping the pH value and the specific gravity at prescribed numerical values specified in Table 1. The liquid or dry film photoresists were carefully scrutinized and gently scratched using equipment in order to observe whether there is discoloration, softening or stripping of the photoresists. The results of the test are recorded in Table 3.

Embodiments 2-3

The procedures of embodiment 1 were repeated respectively, using the designated content of each component and parameters of the automatic detection and feeding control machine as specified in embodiments 2-3 of Table 1 below.

Etch quality test was carried out as mentioned in embodiment 1.

Embodiments 4-5

The procedures of embodiment 1 were repeated respectively, using the designated content of each component and parameters of the automatic detection and feeding control machine as specified in embodiments 4-5 of Table 1 below. Wherein in step 2, 63.5 g of cupric chloride was added into per liter of the sub-etchant obtained in step 1 to allow the concentration of copper ions in the obtained solution to reach the value specified in embodiments 4-5 of Table 1.

Etch quality test was carried out as mentioned in embodiment 1.

Embodiments 6-7

The procedures of embodiment 1 were repeated respectively, using the designated content of each component and parameters of the automatic detection and feeding control machine as specified in embodiments 6-7 of Table 1 below. Wherein in step 2, 84.7 g of cupric chloride was added into per liter of the sub-etchant obtained in step 1 to allow the concentration of copper ions in the obtained solution to reach the value specified in embodiments 6-7 of Table 1.

Etch quality test was carried out as mentioned in embodiment 1.

Embodiments 8

The procedures of embodiment 1 were repeated respectively, using the designated content of each component and parameters of the automatic detection and feeding control machine as specified in embodiments 8 of Table 1 below. Wherein in step 2, 127 g of cupric chloride was added into per liter of the sub-etchant obtained in step 1 to allow the concentration of copper ions in the obtained solution to reach the value specified in embodiments 8 of Table 1.

Etch quality test and impact testing on photoresists were carried out as mentioned in embodiment 1.

Embodiments 9

The procedures of embodiment 1 were repeated respectively, using the designated content of each component and parameters of the automatic detection and feeding control machine as specified in embodiments 9 of Table 1 below. Wherein in step 2, 127 g of cupric chloride was added into per liter of the sub-etchant obtained in step 1 to allow the concentration of copper ions in the obtained solution to reach the value specified in embodiments 9 of Table 1.

Etch quality test was carried out as mentioned in embodiment 1.

Embodiments 10

The procedures of embodiment 1 were repeated respectively, using the designated content of each component and parameters of the automatic detection and feeding control machine as specified in embodiments 10 of Table 1 below. Wherein in step 2, 317.7 g of cupric chloride was added into per liter of the sub-etchant obtained in step 1 to allow the concentration of copper ions in the obtained solution to reach the value specified in embodiments 10 of Table 1.

Etch quality test was carried out as mentioned in embodiment 1.

Embodiment 11

The procedures of embodiment 1 were repeated respectively, using the designated content of each component and parameters of the automatic detection and feeding control machine as specified in embodiments 11 of Table 1 below. Wherein in step 2, 360 g of cupric chloride was added into per liter of the sub-etchant obtained in step 1 to allow the concentration of copper ions in the obtained solution to reach the value specified in embodiments 11 of Table 1.

Etch quality test was carried out as mentioned in embodiment 1.

Embodiment 12

The procedures of embodiment 1 were repeated respectively, using the designated content of each component and parameters of the automatic detection and feeding control machine as specified in embodiments 12 of Table 1 below. Wherein in step 2, 63.5 g of cupric chloride was added into per liter of the sub-etchant obtained in step 1 to allow the concentration of copper ions in the obtained solution to reach the value specified in embodiments 12 of Table 1.

Etch quality test was carried out as mentioned in embodiment 1.

Embodiment 13

The procedures of embodiment 1 were repeated respectively, using the designated content of each component and parameters of the automatic detection and feeding control machine as specified in embodiments 13 of Table 1 below. Wherein in step 2, 84.7 g of cupric chloride was added into per liter of the sub-etchant obtained in step 1 to allow the concentration of copper ions in the obtained solution to reach the value specified in embodiments 13 of Table 1.

Etch quality test was carried out as mentioned in embodiment 1.

Embodiment 14

The procedures of embodiment 1 were repeated respectively, using the designated content of each component and parameters of the automatic detection and feeding control machine as specified in embodiments 14 of Table 1 below. Wherein in step 2, 127 g of cupric chloride was added into per liter of the sub-etchant obtained in step 1 to allow the concentration of copper ions in the obtained solution to reach the value specified in embodiments 14 of Table 1.

Etch quality test was carried out as mentioned in embodiment 1.

Embodiment 15

The procedures of embodiment 1 were repeated respectively, using the designated content of each component and parameters of the automatic detection and feeding control machine as specified in embodiments 15 of Table 1 below. Wherein in step 2, 317.7 g of cupric chloride was added into per liter of the sub-etchant obtained in step 1 to allow the concentration of copper ions in the obtained solution to reach the value specified in embodiments 15 of Table 1.

Etch quality test was carried out as mentioned in embodiment 1.

Embodiment 16

The procedures of embodiment 1 were repeated respectively, using the designated content of each component and parameters of the automatic detection and feeding control machine as specified in embodiments 16 of Table 1 below. Wherein in step 2, 360 g of cupric chloride was added into per liter of the sub-etchant obtained in step 1 to allow the concentration of copper ions in the obtained solution to reach the value specified in embodiments 16 of Table 1.

Etch quality test was carried out as mentioned in embodiment 1.

Embodiment 17

The procedures of embodiment 1 were repeated respectively, using the designated content of each component and parameters of the automatic detection and feeding control machine as specified in embodiments 17 of Table 1 below. Wherein in step 2, 63.5 g of cupric chloride was added into per liter of the sub-etchant obtained in step 1 to allow the concentration of copper ions in the obtained solution to reach the value specified in embodiments 17 of Table 1.

Etch quality test was carried out as mentioned in embodiment 1.

Embodiment 18

The procedures of embodiment 1 were repeated respectively, using the designated content of each component and parameters of the automatic detection and feeding control machine as specified in embodiments 18 of Table 1 below. Wherein in step 2, 84.7 g of cupric chloride was added into per liter of the sub-etchant obtained in step 1 to allow the concentration of copper ions in the obtained solution to reach the value specified in embodiments 18 of Table 1.

Etch quality test was carried out as mentioned in embodiment 1.

Embodiments 19

The procedures of embodiment 1 were repeated respectively, using the designated content of each component and parameters of the automatic detection and feeding control machine as specified in embodiments 19 of Table 1 below. Wherein in step 2, 127 g of cupric chloride was added into per liter of the sub-etchant obtained in step 1 to allow the concentration of copper ions in the obtained solution to reach the value specified in embodiments 19 of Table 1.

Etch quality test and impact testing on photoresists were carried out as mentioned in embodiment 1.

Embodiment 20

The procedures of embodiment 1 were repeated respectively, using the designated content of each component and parameters of the automatic detection and feeding control machine as specified in embodiments 20 of Table 1 below. Wherein in step 2, 317.7 g of cupric chloride was added into per liter of the sub-etchant obtained in step 1 to allow the concentration of copper ions in the obtained solution to reach the value specified in embodiments 20 of Table 1.

Etch quality test and impact testing on photoresists were carried out as mentioned in embodiment 1.

Embodiment 21

Step 1: at ambient temperature and pressure, according to the designated components as illustrated in Table 1 below, selected raw materials are dissolved in water to prepare the sub-etchant. In addition, 25% ammonium hydroxide was prepared;

Step 2: cupric chloride was added into per liter of the sub-etchant obtained in step 1; the added amount of cupric chloride was obtained by calculation according to the set value of the concentration of copper ions in the solution listed in Table 1:

$$\frac{\text{molar mass of } CuCl_2}{\text{molar mass of copper ion}} = \frac{\text{mass of } CuCl_2 \text{ to be added per liter of sub-etchant}}{\text{mass of copper ion to be added per liter of sub-etchant}} \quad \text{(Formula 1)}$$

Wherein the molar mass of cupric chloride is 134.5 g/mol; and the molar mass of copper ion is 63.5 g/mol. The mass of cupric chloride to be added into per liter of sub-etchant is 360 g according to the value specified in embodiment 21 of Table 1.

Step 3: the solution obtained in step 2 was poured into an etchant tank, and sensor probes of the automatic detection and feeding control machine were immersed into the etchant.

Step 4: the 25% of ammonium hydroxide obtained in step 1 was poured into an ammonium hydroxide supplement tank, which was connected to a charging pump controlled by a pH numerical control meter of the automatic detection and feeding control machine; the sub-etchant obtained in step 1 was poured into a sub-etchant supplement tank, which was connected to a charging pump controlled by a specific gravity numerical control meter of the automatic detection and feeding control machine.

Step 5: the temperature of the etchant tank was set to 50° C., the pressure of spray nozzles of the etching machine was set to 2 kg/cm$^2$, and the pH value was set as the value specified in Table 1. The automatic detection and feeding control machine was started and the etchant was prepared; when the pH of the etchant arrived at the set numerical value, the numerical value of the specific gravity numerical control meter was set according to the reading of a hydrometer on the automatic detection and feeding control machine.

Step 6: the etching operation was started. All the components in the etchant were automatically charged and balanced by the automatic detection and feeding control machine, keeping the pH value and the specific gravity at the numerical values specified in Table 1.

Etch quality test and impact testing on photoresists were carried out as mentioned in embodiment 1.

Comparative Example 1

Step 1: at ambient temperature and pressure, according to the designated components as listed in Table 1 below, selected raw materials are dissolved in water to prepare the sub-etchant.

Step 2: cupric chloride was added into per liter of the sub-etchant obtained in step 1; the added amount of cupric chloride was obtained by calculation according to the set value of the concentration of copper ions in the solution listed in Table 1:

$$\frac{\text{molar mass of } CuCl_2}{\text{molar mass of copper ion}} = \frac{\text{mass of } CuCl_2 \text{ to be added per liter of sub-etchant}}{\text{mass of copper ion to be added per liter of sub-etchant}} \quad \text{(Formula 1)}$$

Wherein the molar mass of cupric chloride is 134.5 g/mol; and the molar mass of copper ion is 63.5 g/mol. The mass of cupric chloride to be added into per liter of sub-etchant is 127 g according to the value specified in Table 1.

Step 3: the solution obtained in step 2 was poured into an etchant tank, and sensor probes of the automatic detection and feeding control machine were immersed into the etchant.

Step 4: the sub-etchant obtained in step 1 was poured into a sub-etchant tank, which was connected to the charging pump controlled by a specific gravity numerical control meter of the automatic detection and feeding control machine; an 20% ammonium hydroxide solution was poured into an ammonium hydroxide supplement tank, which was connected to a charging pump controlled by a pH numerical control meter of the automatic detection and feeding control machine; the temperature of the etchant tank was set to 50° C., the pressure of spray nozzles of the etching machine was set as 2 kg/cm$^2$.

Step 5: the etching operation was started. The sub-etchant and the ammonium hydroxide solution were automatically charged and all the components in the etchant were balanced by the automatic detection and feeding control machine, keeping the specific gravity at 1.20 g/ml and the pH value at 7.2.

Test on Etch Quality

The test was carried out using PCBs with size of 620×540 mm, copper foil thickness of 1 oz, line width and line spacing of 50.8 μm and pure copper etching rate test boards with size of 500×300×1.5 mm via spray corrosion testing in an etching machine. The etching rate and etch factor K were calculated using methods known in the art, e.g., those described in *Printed Circuit Technique* by Li Xueming, Occupational Skill Testing Authority of Electronic Industry of Ministry of Industry and Information Technology, fifth edition, p 387-389; *"Theory and Application of Metal Corrosion"*, Wei Baoming, Chemical Industry Press, p 5-7; *Discussion in Methods of Etch Factor Calculation*, Tian Ling, et al., printed circuit information, 2007 No. 12, p 55-56. The calculated results of etching rate and etch factor K are presented in Table 2.

Comparative Examples 2

Step 1: at ambient temperature and pressure, according to the designated components as listed in Table 1 below, selected raw materials are dissolved in water to prepare the sub-etchant.

Step 2: cupric chloride was added into per liter of the sub-etchant obtained in step 1; the added amount of cupric chloride was obtained by calculation according to the set value of the concentration of copper ions in the solution listed in Table 1:

$$\frac{\text{molar mass of } CuCl_2}{\text{molar mass of copper ion}} = \frac{\text{mass of } CuCl_2 \text{ to be added per liter of sub-etchant}}{\text{mass of copper ion to be added per liter of sub-etchant}} \quad \text{(Formula 1)}$$

Wherein the molar mass of cupric chloride is 134.5 g/mol; and the molar mass of copper ion is 63.5 g/mol. The mass of cupric chloride to be added into per liter of sub-etchant is 63.5 g according to the value specified in Table 1.

Step 3: the solution obtained in step 2 was poured into an etchant tank, and sensor probes of the automatic detection and feeding control machine were immersed into the etchant.

Step 4: the sub-etchant obtained in step 1 was poured into a sub-etchant tank, which was connected to the charging pump controlled by a specific gravity numerical control meter of the automatic detection and feeding control machine; the temperature of the etchant tank was set to 50° C., the pressure of spray nozzles of the etching machine was set as 2 kg/cm$^2$.

Step 5: the etching operation was started. The sub-etchant was automatically charged and all the components in the etchant were balanced by the automatic detection and feeding control machine, keeping the specific gravity at the numerical values specified in Table 1.

Test on Etch Quality

The test was carried out using PCBs with size of 620×540 mm, copper foil thickness of 1 oz, line width and line spacing of 50.8 μm and pure copper etching rate test boards with size of 500×300×1.5 mm via spray corrosion testing in an etching machine. The etching rate and etch factor K were calculated using methods known in the art, e.g., those described in *Printed Circuit Technique* by Li Xueming, Occupational Skill Testing Authority of Electronic Industry of Ministry of Industry and Information Technology, fifth edition, p 387-389; *"Theory and Application of Metal Corrosion"*, Wei Baoming, Chemical Industry Press, p 5-7; *Discussion in Methods of Etch Factor Calculation*, Tian Ling, et al., printed circuit information, 2007 No. 12, p 55-56. The calculated results of etching rate and etch factor K are presented in Table 2.

Comparative Examples 3

The procedures of comparative example 2 were repeated respectively, using the designated content of each component and parameters of the automatic detection and feeding control machine as specified in comparative example 3 of Table 1 below. Wherein in step 2, 127 g of cupric chloride was added into per liter of the sub-etchant obtained in step 1 to allow the concentration of copper ions in the obtained solution to reach the value specified in comparative example 3 of Table 1.

Etch quality test was carried out as mentioned in comparative example 2.

Comparative Examples 4

The procedures of comparative example 2 were repeated respectively, using the designated content of each component and parameters of the automatic detection and feeding control machine as specified in comparative example 4 of Table 1 below. Wherein in step 2, 317.7 g of cupric chloride was added into per liter of the sub-etchant obtained in step 1 to allow the concentration of copper ions in the obtained solution to reach the value specified in comparative example 4 of Table 1.

Etch quality test was carried out as mentioned in comparative example 2.

Testing the Impact on Photoresists:

When the various process parameters of the automatic detection and feeding control machine in step 3 arrived at set numerical values, printed circuit test boards with the size of 500×300×1.5 mm, were coated with either liquid or dry film photoresists, and were employed for spray corrosion testing in the etching machine for 1 min. The automatic detection and feeding control machine automatically recharged and balanced each component in the etchant, keeping the pH value and the specific gravity at prescribed numerical values specified in Table 1. The liquid or dry film photoresists were carefully scrutinized and gently scratched using equipment in order to observe whether there is discoloration, softening or stripping of the photoresists. The results of the test are recorded in Table 3.

Data Analysis of Tables 1-3:

Comparative example 1 belongs to the etching system mentioned in the application of Chinese invention CN201510176486.9. Comparing comparative example 1 with embodiment 19, both etchant have the same pH value and concentration of copper ions with each other, whereas a higher etching rate and larger etch factor were obtained in embodiment 19. Therefore the etching system of the invention has a better etching speed and better etching quality.

Comparative example 2-4 are commonly-seen traditional alkaline etching systems at present. According to the results, the etching speeds were extremely low when the pH value was less than 8, and that shows traditional alkaline etching systems with a pH value below 8 are unsuitable for industrialized production. Wherein, comparative example 4 has an identical pH value and concentration of copper ions with embodiment 10, embodiment 15 and embodiment 20, but the etching rates and the etch factors of the three embodiment are all better than those of comparative example 4. It can be seen that the etching system of the invention has a better etching speed and better etching quality.

TABLE 1

| Etching system | Concentration of copper ions g/L | pH | Specific gravity g/ml | Sub-etchant water wt % | Ammonium chloride wt % | Ammonium bicarbonate wt % | Ammonium carbonate wt % | Formic acid wt % | Ammonium Formate wt % |
|---|---|---|---|---|---|---|---|---|---|
| Comparative example 1 | 60.01 | 8.0 | 1.17 | 72 | 22 | 0 | 0 | 5 | 0 |
| Comparative example 2 | 30 | 7.0 | 1.10 | 55 | 20 | 0 | 0 | 0 | 0 |
| Comparative example 3 | 60.01 | 8.0 | 1.13 | 55 | 20 | 0 | 0 | 0 | 0 |
| Comparative example 4 | 160 | 8.8 | 1.22 | 55 | 20 | 0 | 0 | 0 | 0 |
| Embodiment 1 | 90 | 7.2 | 1.17 | 49.7 | 22 | 0 | 18 | 3 | 0 |
| Embodiment 2 | 90 | 7.2 | 1.17 | 54.5 | 22 | 0 | 18 | 0 | 3 |
| Embodiment 3 | 90 | 7.6 | 1.17 | 49.4 | 22 | 0.3 | 18 | 2.5 | 0.1 |
| Embodiment 4 | 30 | 7.0 | 1.18 | 26 | 10 | 0 | 19 | 20 | 5 |
| Embodiment 5 | 30 | 7.0 | 1.27 | 15 | 10 | 37 | 8 | 25 | 0 |
| Embodiment 6 | 40 | 7.8 | 1.19 | 26 | 10 | 0 | 9 | 10 | 11 |
| Embodiment 7 | 40 | 8.0 | 1.28 | 13 | 10 | 25 | 20 | 25 | 0 |
| Embodiment 8 | 60.01 | 7.8 | 1.21 | 26 | 10 | 0 | 9 | 10 | 11 |
| Embodiment 9 | 60.01 | 8.0 | 1.30 | 13 | 10 | 25 | 20 | 25 | 0 |
| Embodiment 10 | 160 | 8.8 | 1.23 | 54.99 | 30 | 0.01 | 0 | 0.0002 | 0 |
| Embodiment 11 | 170 | 8.4 | 1.25 | 54.99 | 30 | 0 | 0.01 | 0.0002 | 0 |
| Embodiment 12 | 30 | 7.0 | 1.23 | 27 | 15 | 18 | 12 | 0 | 13 |
| Embodiment 13 | 40 | 8.0 | 1.24 | 17 | 15 | 15 | 15 | 3 | 2 |
| Embodiment 14 | 60.01 | 8.0 | 1.26 | 17 | 15 | 15 | 15 | 3 | 2 |
| Embodiment 15 | 160 | 8.8 | 1.23 | 47.49 | 30 | 2 | 0 | 0 | 0 |
| Embodiment 16 | 170 | 8.4 | 1.25 | 47.49 | 30 | 1 | 1 | 0 | 0 |
| Embodiment 17 | 30 | 7.0 | 1.21 | 40 | 15 | 8 | 17 | 5 | 1 |
| Embodiment 18 | 40 | 8.0 | 1.23 | 30 | 15 | 10 | 15 | 0 | 5 |
| Embodiment 19 | 60.01 | 8.0 | 1.25 | 30 | 15 | 10 | 15 | 0 | 5 |
| Embodiment 20 | 160 | 8.8 | 1.23 | 43.9 | 25 | 0 | 5 | 0 | 0 |
| Embodiment 21 | 170 | 8.4 | 1.25 | 68.9 | 25 | 4 | 1 | 0 | 0 |

| Etching system | Sub-etchant Malic acid wt % | Ammonium malate wt % | Citric acid wt % | Ammonium citrate wt % | Hydroxyl-amine hydrochloride wt % | Hydroxyl-amine sulphate wt % | Hydrazine-hydrate wt % | Ammonium hydroxide wt % |
|---|---|---|---|---|---|---|---|---|
| Comparative example 1 | 0 | 0 | 0 | 0 | 0 | 0 | 0 | 1 |
| Comparative example 2 | 0 | 0 | 0 | 0 | 0 | 0 | 0 | 25 |
| Comparative example 3 | 0 | 0 | 0 | 0 | 0 | 0 | 0 | 25 |
| Comparative example 4 | 0 | 0 | 0 | 0 | 0 | 0 | 0 | 25 |
| Embodiment 1 | 0 | 0 | 0 | 0 | 1.3 | 0 | 0 | 6 |
| Embodiment 2 | 0 | 0 | 0 | 0 | 0 | 0 | 2.5 | 0 |
| Embodiment 3 | 0.1 | 0.1 | 0.1 | 0.1 | 0 | 1.3 | 0 | 6 |
| Embodiment 4 | 0 | 0 | 0 | 0 | 0 | 0 | 20 | 0 |
| Embodiment 5 | 0 | 0 | 0 | 0 | 0 | 0 | 5 | 0 |
| Embodiment 6 | 1 | 1 | 1 | 1 | 1 | 1 | 18 | 10 |
| Embodiment 7 | 0 | 0 | 0 | 0 | 0 | 0 | 5 | 2 |
| Embodiment 8 | 1 | 1 | 1 | 1 | 1 | 1 | 18 | 10 |
| Embodiment 9 | 0 | 0 | 0 | 0 | 0 | 0 | 5 | 2 |
| Embodiment 10 | 0 | 0 | 0 | 0 | 0 | 0.0001 | 0 | 15 |

TABLE 1-continued

| | | | | | | | | |
|---|---|---|---|---|---|---|---|---|
| Embodiment 11 | 0 | 0 | 0 | 0 | 0 | 0.0001 | 0 | 15 |
| Embodiment 12 | 0 | 0 | 0 | 0 | 1 | 0 | 14 | 0 |
| Embodiment 13 | 2 | 2 | 2 | 2 | 1 | 1 | 13 | 10 |
| Embodiment 14 | 2 | 2 | 2 | 2 | 1 | 1 | 13 | 10 |
| Embodiment 15 | 0.5 | 0 | 0 | 0 | 0 | 0.01 | 0 | 20 |
| Embodiment 16 | 0.5 | 0 | 0 | 0 | 0.01 | 0 | 0 | 20 |
| Embodiment 17 | 1 | 1 | 1 | 1 | 0 | 0 | 10 | 0 |
| Embodiment 18 | 0 | 0 | 0 | 5 | 1 | 1 | 8 | 10 |
| Embodiment 19 | 0 | 0 | 0 | 5 | 1 | 1 | 8 | 10 |
| Embodiment 20 | 1 | 0 | 0 | 0 | 0 | 0.1 | 0 | 25 |
| Embodiment 21 | 0 | 0.5 | 0.5 | 0 | 0 | 0.1 | 0 | 0 |

TABLE 2

| Etching system | Etching rate (μm/min) | Etch factor K | Environmental impact |
|---|---|---|---|
| Comparative example 1 | 55 | 6.8 | Slight ammonia odor |
| Comparative example 2 | 12 | 1.5 | Slight ammonia odor |
| Comparative example 3 | 55 | 6.0 | Obvious ammonia odor |
| Comparative example 4 | 60 | 5.0 | Obvious ammonia odor |
| Embodiment 1 | 35 | 13.2 | No ammonia odor |
| Embodiment 2 | 40 | 12.9 | No ammonia odor |
| Embodiment 3 | 45 | 15.1 | No ammonia odor |
| Embodiment 4 | 23 | 15.3 | Almost no ammonia odor |
| Embodiment 5 | 22 | 15.1 | Almost no ammonia odor |
| Embodiment 6 | 36 | 8.9 | Almost no ammonia odor |
| Embodiment 7 | 40 | 9.1 | Almost no ammonia odor |
| Embodiment 8 | 55 | 9.4 | Almost no ammonia odor |
| Embodiment 9 | 59 | 9.8 | Almost no ammonia odor |
| Embodiment 10 | 62 | 5.5 | Obvious ammonia odor |
| Embodiment 11 | 60 | 7.7 | Obvious ammonia odor |
| Embodiment 12 | 24 | 16.4 | Almost no ammonia odor |
| Embodiment 13 | 39 | 9.0 | Slight ammonia odor |
| Embodiment 14 | 58 | 8.9 | Slight ammonia odor |
| Embodiment 15 | 63 | 6.3 | Obvious ammonia odor |
| Embodiment 16 | 55 | 6.0 | Obvious ammonia odor |
| Embodiment 17 | 22 | 20.1 | Almost no ammonia odor |
| Embodiment 18 | 42 | 13 | Slight ammonia odor |
| Embodiment 19 | 56 | 15.8 | Slight ammonia odor |
| Embodiment 20 | 61 | 6.3 | Obvious ammonia odor |
| Embodiment 21 | 65 | 6.8 | Obvious ammonia odor |

TABLE 3

| Etching system | pH value | Type of photoresist | Observation of etch resist |
|---|---|---|---|
| Comparative example 4 | 8.8 | dry-film | No discoloration; partly striped after gentle scratching |
| | | liquid | No discoloration; partly striped after gentle scratching |
| Embodiment 1 | 7.2 | dry-film | Not discolored, softened or striped |
| | | liquid | Not discolored, softened or striped |
| Embodiment 8 | 7.8 | dry-film | Not discolored, softened or striped |
| | | liquid | Not discolored, softened or striped |
| Embodiment 19 | 8.0 | dry-film | No discoloration; partly striped after gentle scratching |
| | | liquid | No discoloration; partly striped after gentle scratching |

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. An alkaline cupric chloride etchant for printed circuit board, comprising cupric chloride and a sub-etchant, wherein an automatic detection and feeding control machine is used for controlling the specific gravity of the etchant, in order to keep the concentration of copper ions in the etchant to be no less than a set value; the sub-etchant comprises the following components in percentage by weight:

10%-30% $NH_4Cl$;

0.0002%-25% of a first composition, wherein the first composition is carboxylic acid, ammonium carboxylate or a combination thereof;

0.01%-45% of a second composition, wherein the second composition is ammonium carbonate, ammonium bicarbonate or a combination thereof;

0.0001%-20% of a third composition, wherein the third composition is one or more compounds selected from hydroxylamine hydrochloride, hydroxylamine sulphate, and hydrazine hydrate;

and the balance of water;

the initial feed amount B of the cupric chloride is obtained by calculation according to the following formula:

$$B=(134.5/63.5)\times\text{set value } A \text{ of the concentration of copper ions;}$$

control parameters of a production process of the etchant are set as follows: the concentration of copper ions is 30-170 g/L.

2. The high efficiency and environmental friendly alkaline cupric chloride etchant according to claim 1, wherein the sub-etchant comprises the following components in percentage by weight:

15%-30% $NH_4Cl$;

0.5%-13% of the first composition;

2%-30% of the second composition;

0.01%-15% of the third composition;

and the balance of water.

3. The alkaline cupric chloride etchant according to claim 2, wherein the sub-etchant comprises the following components in percentage by weight:

15%-25% $NH_4Cl$;

1%-10% of the first composition;

5%-25% of the second composition;

0.1%-10% the third composition;

and the balance of water.

4. The alkaline cupric chloride etchant according to claim 1, wherein the carboxylic acid is one or more compounds selected from the group comprising formic acid, citric acid and malic acid; the ammonium carboxylate is one or more compounds selected from the group comprising ammonium formate, ammonium citrate and ammonium malate.

5. The alkaline cupric chloride etchant according to claim 1, wherein the etchant further comprises ammonium hydroxide.

6. The alkaline cupric chloride etchant according to claim 5, wherein, based on percentage by weight of the etchant, the etchant further comprises ≤25% by weight of ammonium hydroxide.

7. The alkaline cupric chloride etchant according to claim 6, wherein the control parameters of the production process of the etchant are set as follows: the concentration of copper ions is 30-170 g/L, the pH value is 7.0-8.8.

8. The alkaline cupric chloride etchant according to claim 7, wherein the control parameters of the production process of the etchant are set as follows: the concentration of copper ions is 40-160 g/L, the pH value is 7.0-8.4.

* * * * *